US007730742B2

(12) United States Patent
Wu

(10) Patent No.: US 7,730,742 B2
(45) Date of Patent: Jun. 8, 2010

(54) ACCELERATED HEAT EXCHANGER

(75) Inventor: Guolian Wu, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 454 days.

(21) Appl. No.: 11/644,558

(22) Filed: Dec. 22, 2006

(65) Prior Publication Data

US 2008/0149310 A1 Jun. 26, 2008

(51) Int. Cl.
*F25B 39/02* (2006.01)

(52) U.S. Cl. ..... 62/515

(58) Field of Classification Search ..... 165/146, 165/147, 151; 62/515, 407
See application file for complete search history.

(56) References Cited

U.S. PATENT DOCUMENTS 2,991,048 A * 7/1961 Rabin ..... 165/110
3,745,786 A 7/1973 Laughlin et al.
5,000,258 A * 3/1991 Negishi ..... 165/151
5,099,913 A 3/1992 Kadle
5,137,082 A 8/1992 Shimoya et al.
5,157,941 A * 10/1992 Cur et al. ..... 62/441
5,172,759 A * 12/1992 Shimoya et al. ..... 165/110
5,826,442 A 10/1998 Lee
6,105,383 A * 8/2000 Reimann et al. ..... 62/285
7,073,347 B2 7/2006 Hermes et al.
2006/0179876 A1 8/2006 Yagisawa

OTHER PUBLICATIONS

Mechanical Engineers Handbook. Second Edition. Myer Kutz Wiley-Interscience Publication. John Wiley and Sons.*

* cited by examiner

*Primary Examiner*—Melvin Jones
(74) *Attorney, Agent, or Firm*—Kirk W. Goodwin; Greer, Burns & Crain, Ltd

(57) ABSTRACT

A heat transfer device includes a tube with a first fluid inlet and outlet and is arranged to form a plurality of parallel elongated segments. An enclosure defines a second fluid flow path over an exterior surface of the tube from a second fluid inlet to a second fluid outlet. A wall in the enclosure defines a first section of the second fluid flow path, which first section leads from the second fluid inlet and extends across a first portion of a length of all of the elongated segments of the tube. The wall further defines a second section of the second fluid flow path in the enclosure, which second section extends across a second portion of the length of all of the elongated segments of the tube and leads to the second fluid outlet. The interior wall is shaped and arranged such that a cross sectional area of the second fluid flow path in the enclosure changes along its length from the second fluid inlet to the second fluid outlet.

19 Claims, 2 Drawing Sheets

ACCELERATED HEAT EXCHANGER

BACKGROUND OF THE INVENTION

Heat exchangers or heat transfer devices are known, particularly those used in refrigeration appliances.

U.S. Pat. No. 5,157,941 discloses an evaporator which has a trapezoid shaped fin structure to result in a trapezoid shaped tube coil structure which causes air flow through the evaporator to accelerate as the cross sectional area of the air flow path decreases from the air inlet to the air outlet. A trapezoidal shaped tube and fin evaporator is also disclosed in U.S. Pat. No. 5,826,442.

Other types of heat exchangers include plate type refrigerant evaporators such as those disclosed in U.S. Pat. Nos. 5,172,759, 5,099,913 and 5,137,082 in which a wall is provided in the interior of the refrigerant plate to allow refrigerant flowing through the plate to expand or compress between an inlet and an outlet.

It would be an improvement in the art if there were provided a fluid heat transfer device that provided for the acceleration of one of the fluids through the heat transfer device, yet would not require a specially shaped arrangement of the tubes of the heat transfer device and which could be incorporated into presently existing heat exchangers.

SUMMARY OF THE INVENTION

The present invention provides a heat transfer device or heat exchanger which, in some embodiments, may be used in a refrigeration appliance, such as part of an evaporator or part of a condenser, and which can be incorporated into existing heat exchangers.

In an embodiment of the invention, the heat transfer device includes a tube having a first fluid inlet and a first fluid outlet, the tube arranged to form a plurality of generally parallel elongated segments of the tube. An enclosure encloses the tube to define at least a part of a flow path for a second fluid over an exterior surface of the tube from a second fluid inlet to a second fluid outlet. A wall interior of the enclosure defines a first section of the flow path for the second fluid in the enclosure which first section leads from the second fluid inlet and extends across at least a first portion of a length of substantially all of the elongated segments of the tube. The wall further defines a second section of the flow path for the second fluid in the enclosure which second section extends across at least a second portion of the length of substantially all of the elongated segments of the tube and leads to the second fluid outlet. The interior wall is shaped and arranged in the enclosure such that a cross sectional area of the flow path for the second fluid in the enclosure changes along its length from the second fluid inlet to the second fluid outlet.

In an embodiment, the tube has a substantially constant cross sectional area along a length of the tube from the first fluid inlet to the first fluid outlet.

In an embodiment, the elongated segments of the tube are connected to each other in series in a serpentine path.

In an embodiment, an interior of the enclosure is substantially rectangular with a generally constant cross-sectional area along its height and long its length.

In an embodiment, the elongated segments of the tube are generally straight.

In an embodiment, the first section of the flow path for the second fluid extends in a first direction substantially perpendicular to the length of the elongated segments and the second section of the flow path for the second fluid extends in a second, opposite direction also substantially perpendicular to the length of the elongated segments.

In an embodiment, the wall is substantially planar and is arranged at an acute angle to the length of the elongated segments of the tube.

In an embodiment, the wall has a zig-zag shape with an alternating series of sections parallel and perpendicular to the length of the straight segments of the tube.

In an embodiment, the heat transfer device further includes a plurality of fins arranged in engagement with the exterior surface of the tube, the fins arranged to guide the second fluid flowing over the exterior surface of the tube to effect a heat transfer from one of the fluids to the other via thermal conduction through the fins and tube.

In an embodiment, each fin lies in a plane generally perpendicular to the length of the elongated segments of the tube.

In an embodiment, the first section of the flow path for the second fluid has a downstream end at one end of the wall with a cross sectional area substantially identical to a cross sectional area of the second section of the flow path for the second fluid at an upstream end at the same end of the wall.

In an embodiment, the cross sectional area of the flow path for the second fluid in the enclosure decreases along its length from the second fluid inlet to the second fluid outlet.

In an embodiment of the invention, the heat transfer device includes a tube arranged in a serpentine path of elongated straight segments joined by u-shaped returns to form a plurality of parallel straight segments of the tube to carry a first fluid from a first fluid inlet to a first fluid outlet. A plurality of fins are arranged in engagement with an exterior surface of the tube, each fin lying in a plane generally perpendicular to a length of the straight segments of the tube. The fins are arranged to guide a second fluid flowing over the exterior surface of the tube to effect a heat transfer from one of the fluids to the other via thermal conduction through the fins and tube. An enclosure encloses the tube and fins to define at least a part of a flow path for the second fluid in a region of the tube and fins from a second fluid inlet to a second fluid outlet. A wall interior of the enclosure defines a first section of the flow path for the second fluid in the enclosure. This first section leads from the second fluid inlet and extends in a first direction substantially perpendicular to a length of the elongated segments of the tube. The wall further defines a second section of the flow path for the second fluid in the enclosure. This second section extends in an opposite direction from the first section substantially perpendicular to the length of the elongated segments of the tube and leads to the second fluid outlet. The interior wall is shaped and arranged in the enclosure such that a cross sectional area of the flow path for the second fluid in the enclosure changes along its length from the second fluid inlet to the second fluid outlet.

In an embodiment, the first section of the flow path for the second fluid has a downstream end at one end of the wall with a cross sectional area substantially identical to a cross sectional area of the second section of the flow path for the second fluid at an upstream end at the same end of the wall.

In an embodiment, the cross sectional area of the flow path for the second fluid in the enclosure decreases along its length from the second fluid inlet to the second fluid outlet.

In an embodiment, the first section of the flow path for the second fluid extends across at least a portion of the length of substantially all of the elongated segments of the tube and the second section of the flow path for the second fluid extends across at least a portion of the length of substantially all of the elongated segments of the tube.

In an embodiment of the invention, a method of transferring heat from one fluid to another is provided which includes the steps of flowing a first fluid through a tube from a first fluid inlet to a first fluid outlet, the tube arranged to form a plurality of generally parallel elongated segments of the tube, flowing a second fluid within an enclosure along a first section of a flow path from a second fluid inlet across an exterior surface of at least a first portion of a length of substantially all of the elongated segments of the tube, and along a second section of the flow path across the exterior surface of at least a second portion of the length of substantially all of the elongated segments of the tube and to the second fluid outlet, and successively changing a cross sectional area within the enclosure of the flow path of the second fluid causing a velocity of the second fluid to change as it flows along the flow path.

In an embodiment, the second fluid from the second fluid inlet is guided in a first direction substantially perpendicular to the length of the elongated segments of the tube, and then is caused to reverse direction and is guided in a second, opposite direction also substantially perpendicular to the length of the elongated segments of the tubes to the second fluid outlet.

In an embodiment, the cross sectional area of the flow path of the second fluid in the enclosure is successively decreased from the second fluid inlet to the second fluid outlet.

The inclusion and arrangement of the interior wall, and reconnection of the second fluid inlet or outlet, would permit the present invention to be used in an existing tube and fin style heat exchanger without modification of the tubes or fins.

DETAILED DESCRIPTION OF THE PREFERRED EMBODIMENT

Figure 1:
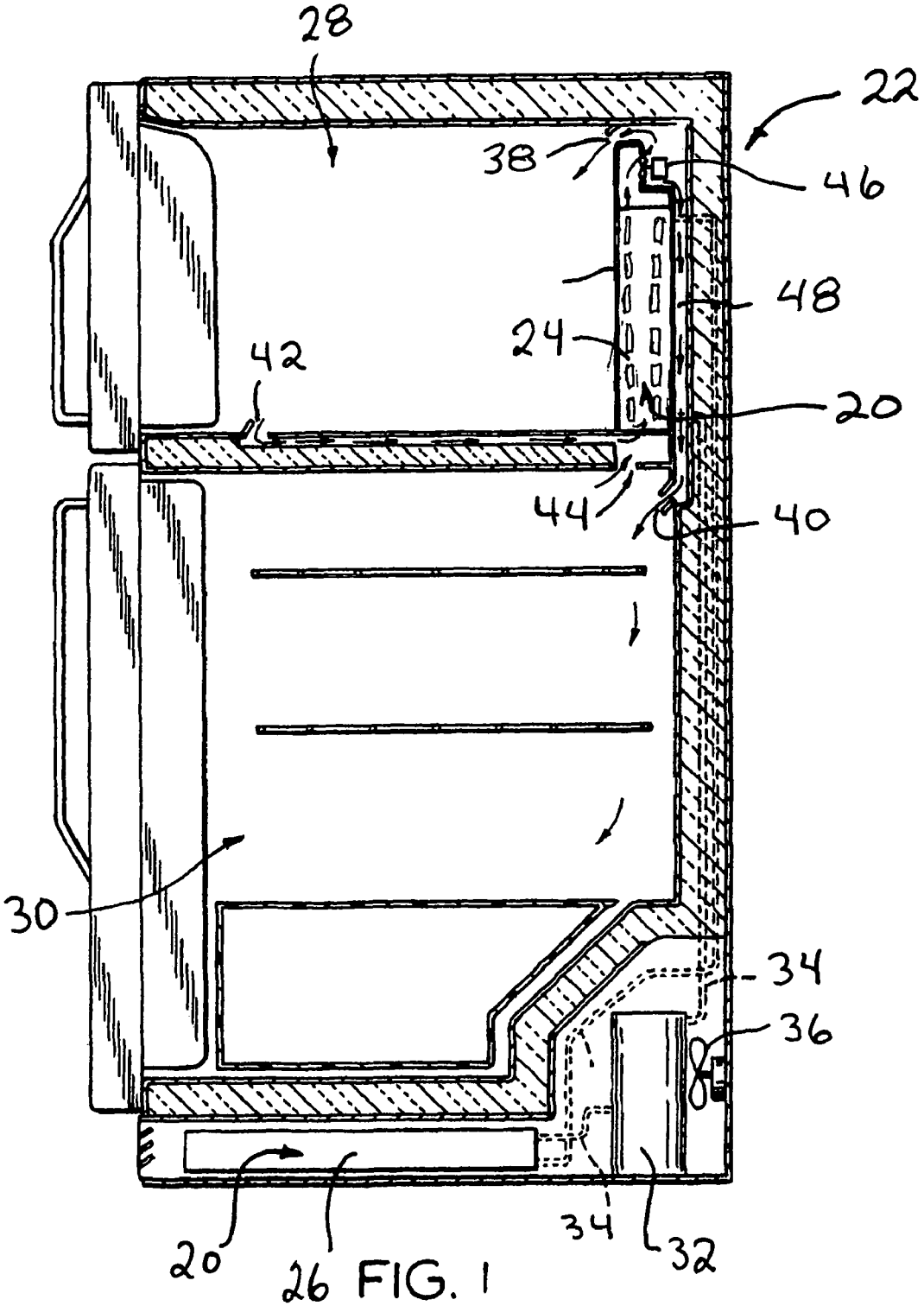
FIG. 1 is a side sectional view of a refrigeration appliance incorporating a heat transfer device embodying the principles of the present invention.

The present invention provides a heat transfer device or heat exchanger 20. As an example of an environment in which the heat transfer device 20 may be used, FIG. 1 illustrates a refrigeration appliance 22 in which the heat transfer device embodying the present invention may be used in either the evaporator 24 or the condenser 26, or both. It will be understood that the top mount refrigerator 22 of FIG. 1 is only one type of refrigeration appliance that the present invention may be utilized in. As well as other types of refrigerators, such as bottom mount and side-by-side refrigerators, the invention can also be used in freezers, such as upright models and chest models, and also in other appliances utilizing a refrigeration circuit, such as air conditioners and dehumidifiers.

The refrigerator 22 of FIG. 1 includes an upper compartment 28 and a lower compartment 30 for storing food or other articles to be cooled or frozen. The upper compartment 28 may be used primarily for frozen food items and the lower compartment 30 may be used for cooled or refrigerated food items.

The refrigerant and cooling air circuits are also located within the housing of refrigerator 22. The refrigerant circuit includes a compressor 32, the condenser 26, the evaporator 24 and a sealed refrigerant system including tubes 34 for connecting these elements. The tubes 34 contain the refrigerant fluid. The portion of the refrigerator housing containing the condenser 26 may also include a condenser fan 36. Except as set forth herein these elements are normally found in refrigerators and are well understood by those skilled in the art.

Similarly, cooling air circuits are normally found in refrigerators. In general, previous cooling air circuits have fostered air flow from the evaporator 24 through vents 38 into the compartment 28 for frozen items. A relatively small portion of the cooling air then typically gets diverted through an air duct 40 to enter the refrigerator compartment 30. The freezer portion of the cooling air returns to the evaporator 24 through vents 42. Cooling air in the refrigerator compartment 30 returns to the evaporator 24 through vents 44.

A fan 46 is, for example, employed to serve as an impeller to cause movement of the cooling air within this circuit. The passageways 48 between the evaporator 24 and the vents of the cooling air circuit can be located and dimensioned according to the specific configuration desired for the refrigerator 22. To avoid unnecessary complication the drawings of this application illustrate the passageways for the cooling air flow only in the vicinity of the evaporator.

Figure 2:
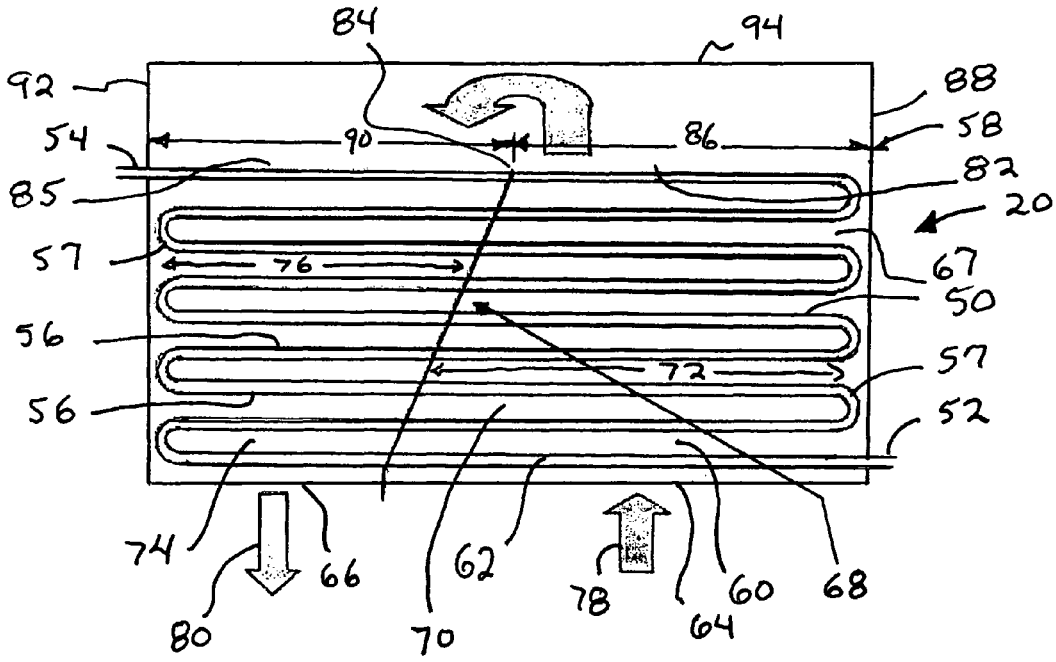
FIG. 2 is a schematic sectional view of a first embodiment of the heat transfer device in isolation.

An embodiment of the heat transfer device 20 incorporating the present invention is shown in isolation in FIG. 2. The heat transfer device 20 includes a tube 50 having a first fluid inlet 52 and a first fluid outlet 54. The tube 50, in some embodiments, may have a substantially constant cross sectional area along a length of the tube from the first fluid inlet 52 to the first fluid outlet 54. In other embodiments, the cross sectional area may vary along the length of the tube from the first fluid inlet 52 to the first fluid outlet 54.

This tube 50, when in a refrigeration circuit would communicate with the refrigeration tubes 34. The tube 50 is arranged to form a plurality of generally parallel elongated segments 56 of the tube. In the illustrated embodiment, the elongated segments 56 of the tube 50 are connected to each other in series by u-shaped returns 57 in a serpentine path. In other embodiments, the elongated segments 56 might be connected in parallel with manifolds at each end of the segments to which the segments connect in common. Also, in the embodiment shown, the elongated segments 56 of the tube 50 are generally straight, although in other embodiments they might be bent or curved.

An enclosure 58 encloses the tube 50 to define at least a part of a flow path 60 for a second fluid over an exterior surface 62 of the tube from a second fluid inlet 64 to a second fluid outlet 66. The enclosure 58 may be formed of a separate housing, or may be formed from the walls of various disparate components. In an embodiment, an interior 67 of the enclosure 58 is substantially rectangular with a generally constant cross-sectional area along its height and long its length. Typically, the tube 50 extends exteriorly of the enclosure 58 such that the first fluid inlet 52 and the first fluid outlet 54 are positioned outside of the enclosure.

A wall 68 interior of the enclosure 58 defines a first section 70 of the flow path 60 for the second fluid in the enclosure. This first section 70 leads from the second fluid inlet 64 and extends across at least a first portion 72 of a length of substantially all of the elongated segments 56 of the tube 50. The wall 68 further defines a second section 74 of the flow path 60 for the second fluid in the enclosure 58. This second section 74 extends across at least a second portion 76 of the length of substantially all of the elongated segments 56 of the tube 50 and leads to the second fluid outlet 66. The interior wall 68 is shaped and arranged in the enclosure 58 such that a cross sectional area of the flow path 60 for the second fluid in the enclosure 58 changes along its length from the second fluid inlet 64 to the second fluid outlet 66. As shown in the arrangement of FIG. 2, the wall 68 is substantially planar and is arranged at an angle to the length of the elongated segments 56 of the tube 50. As illustrated, the cross sectional area of the flow path 60 for the second fluid in the enclosure 58 decreases along its length from the second fluid inlet 64 to the second fluid outlet 66. In other embodiments, the cross sectional area could increase along its length from the second fluid inlet 64 to the second fluid outlet 66.

In the example of FIG. 2, the first section 70 of the flow path 60 for the second fluid extends in a first direction 78 substantially perpendicular to the length of the elongated segments 56 and the second section 74 of the flow path for the second fluid extends in a second, opposite direction 80 also substantially perpendicular to the length of the elongated segments. The first section 70 of the flow path 60 for the second fluid has a downstream end 82 at one end 84 of the wall 68 with a cross sectional area substantially identical to a cross sectional area of an upstream end 85 of the second section 74 of the flow path for the second fluid at the same end 84 of the wall. In an enclosure 58 in which the walls lying in the plane of the drawing of FIG. 2 are parallel, this means that a distance 86 from the wall 68 to a side wall 88 at the downstream end 82 of the first section 70 of the flow path 60 is the same as a distance 90 from the wall to a side wall 92 at the upstream end 85 of the second section 74 of the flow path. A position and shape of an end wall 94 of the enclosure 58 can be selected to maintain the cross sectional area as the second fluid reverses direction between the first section 70 and the second section 74 of the flow path 60.

Figure 3:
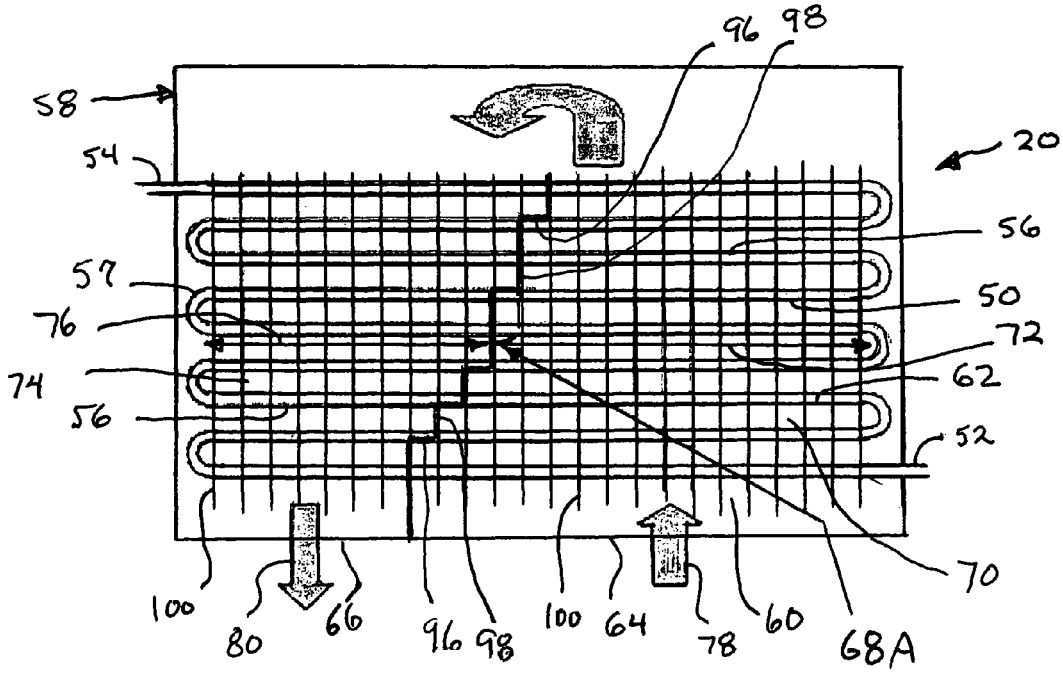
FIG. 3 is a schematic sectional view of a second embodiment of the heat transfer device in isolation.

A shown in the embodiment of the heat transfer device 20 in FIG. 3, the wall 68A has a zig-zag shape with an alternating series of sections 96, 98 parallel and perpendicular to the length of the straight segments 56 of the tube 50.

As also shown in the embodiment of FIG. 3, the heat transfer device 20 further includes a plurality of fins 100 arranged in engagement with the exterior surface 62 of the tube 50. The fins 100 are arranged to guide the second fluid flowing over the exterior surface 62 of the tube 50 to effect a heat transfer from one of the fluids to the other via thermal conduction through the fins and tube. A variety of shapes and configurations of such fins 100 are known in the art, and any such shapes and configurations can be used with the present invention. In an embodiment, each fin 100 lies in a plane generally perpendicular to the length of the elongated segments 56 of the tube 50. By generally perpendicular, it is meant that the angle the fin presents to the second fluid flow should be perpendicular or closer to perpendicular than the angle presented by the interior wall 68A relative to the length of the tube segments 56. The fins 100 could also be used with the embodiment shown in FIG. 2.

Thus, in accordance with the embodiments shown in FIGS. 2 and 3, the heat transfer device 20 includes the tube 50 arranged in a serpentine path of elongated straight segments 56 joined by unshaped returns 57 to form the plurality of parallel straight segments of the tube to carry the first fluid from the first fluid inlet 52 to the first fluid outlet 54. The plurality of fins 100 are arranged in engagement with the exterior surface 62 of the tube 50, each fin lying in a plane generally perpendicular to the length of the straight segments 56 of the tube. The fins 100 are arranged to guide the second fluid flowing over the exterior surface 62 of the tube 50 to effect the heat transfer from one of the fluids to the other via thermal conduction through the fins and tube. The enclosure 58 encloses the tube 50 and fins 100 to define at least a part of the flow path 60 for the second fluid in a region of the tube and fins from the second fluid inlet 64 to the second fluid outlet 66. The wall 68 interior of the enclosure 58 defines the first section 70 of the flow path 60 for the second fluid in the enclosure. This first section 70 leads from the second fluid inlet 64 and extends in the first direction 78 substantially perpendicular to the length of the elongated segments 56 of the tube 50. The wall 68 further defines the second section 74 of the flow path 60 for the second fluid in the enclosure 58. This second section 74 extends in the opposite direction 80 from the first section substantially perpendicular to the length of the elongated segments 56 of the tube 50 and leads to the second fluid outlet 66. The interior wall 68 is shaped and arranged in the enclosure 58 such that a cross sectional area of the flow path 60 for the second fluid in the enclosure changes along its length from the second fluid inlet 64 to the second fluid outlet 66.

In an embodiment, the first section 70 of the flow path 60 for the second fluid extends across at least the portion 72 of the length of substantially all of the elongated segments 56 of the tube 50 and the second section 74 of the flow path for the second fluid extends across at least the portion 76 of the length of substantially all of the elongated segments of the tube.

In an embodiment of the invention, a method of transferring heat from one fluid to another is provided which includes the steps of flowing the first fluid through the tube 50 from the first fluid inlet 52 to the first fluid outlet 54, the tube 50 arranged to form the plurality of generally parallel elongated segments 56 of the tube, flowing the second fluid within the enclosure 58 along the first section 70 of the flow path 60 from the second fluid inlet 64 across the exterior surface 62 of at least the first portion 72 of the length of substantially all of the elongated segments 56 of the tube 50, and along the second section 74 of the flow path 60 across the exterior surface 62 of at least the second portion 76 of the length of substantially all of the elongated segments 56 of the tube 50 and to the second fluid outlet 66, and successively changing a cross sectional area within the enclosure 58 of the flow path 60 of the second fluid causing a velocity of the second fluid to change as it flows along the flow path.

The second fluid from the second fluid inlet 64 may further be guided in the first direction 78 substantially perpendicular to the length of the elongated segments 56 of the tube 50, and then is caused to reverse direction and may be guided in the second, opposite direction 80 also substantially perpendicular to the length of the elongated segments 56 of the tube 50 to the second fluid outlet 66.

Various features of the heat transfer device 20 have been described which may be incorporated singly or in various combinations into a desired system.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

20 heat transfer device
22 refrigeration appliance
24 evaporator
26 condenser
28 upper compartment
30 lower compartment
32 compressor
34 tubes
36 condenser fan
38 vents
40 air duct
42 vents
44 vents

46 fan
48 passageways
50 tube
52 first fluid inlet
54 first fluid outlet
56 elongated segments
57 u-shaped returns
58 enclosure
60 flow path
62 exterior surface
64 second fluid inlet
66 second fluid outlet
67 interior
68 wall
68A wall
70 first section of flow path
72 first portion of length
74 second section of flow path
76 second portion of length
78 first direction
80 second direction
82 downstream end
84 end
85 upstream end
86 distance
88 side wall
90 distance
92 side wall
94 end wall
96 parallel section
98 perpendicular section
100 fins The embodiments of the invention in which an exclusive property or privilege is claimed are defined as follows:

1. A heat transfer device comprising:

a tube having a first fluid inlet and a first fluid outlet, the tube arranged to form a plurality of generally parallel elongated segments of the tube, an enclosure enclosing the tube to define at least a part of a flow path for a second fluid over an exterior surface of the tube from a second fluid inlet to a second fluid outlet, a wall interior of the enclosure to define a first section of the flow path for the second fluid in the enclosure which first section leads from the second fluid inlet and extends across at least a first portion of a length of substantially all of the elongated segments of the tube, the wall further defining a second section of the flow path for the second fluid in the enclosure which second section extends across at least a second portion of the length of substantially all of the elongated segments of the tube and leads to the second fluid outlet, the interior wall being shaped and arranged in the enclosure such that a cross sectional area of the flow path for the second fluid in the enclosure changes along its length from the second fluid inlet to the second fluid outlet.

2. The heat transfer device according to claim 1, wherein the elongated segments of the tube are connected to each other in series in a serpentine path.

3. The heat transfer device according to claim 1, wherein an interior of the enclosure is substantially rectangular with a generally constant cross-sectional area along its height and long its length.

4. The heat transfer device according to claim 1, wherein the first section of the flow path for the second fluid extends in a first direction substantially perpendicular to the length of the elongated segments and the second section of the flow path for the second fluid extends in a second, opposite direction also substantially perpendicular to the length of the elongated segments.

5. The heat transfer device according to claim 1, wherein the wall is substantially planar and is arranged at an angle to the length of the elongated segments of the tube.

6. The heat transfer device according to claim 1, wherein the wall has a zig-zag shape with an alternating series of sections parallel and perpendicular to the length of the straight segments of the tube.

7. The heat transfer device according to claim 1, further including a plurality of fins arranged in engagement with the exterior surface of the tube, each fin lying in a plane generally perpendicular to the length of the elongated segments of the tube, the fins arranged to guide the second fluid flowing over the exterior surface of the tube to effect a heat transfer from one of the fluids to the other via thermal conduction through the fins and tube.

8. The heat transfer device according to claim 1, wherein the heat transfer device forms a portion of at least one of an evaporator and a condenser in a refrigeration appliance.

9. The heat transfer device according to claim 1, wherein the first section of the flow path for the second fluid has a downstream end at one end of the wall with a cross sectional area substantially identical to a cross sectional area of the second section of the flow path for the second fluid at an upstream end at the same end of the wall.

10. The heat transfer device according to claim 1, wherein the cross sectional area of the flow path for the second fluid in the enclosure decreases along its length from the second fluid inlet to the second fluid outlet.

11. A heat transfer device comprising:

a tube arranged in a serpentine path of elongated straight segments joined by u-shaped returns to form a plurality of parallel straight segments of the tube to carry a first fluid from a first fluid inlet to a first fluid outlet, a plurality of fins arranged in engagement with an exterior surface of the tube, each fin lying in a plane generally perpendicular to a length of the straight segments of the tube, the fins arranged to guide a second fluid flowing over the exterior surface of the tube to effect a heat transfer from one of the fluids to the other via thermal conduction through the fins and tube, an enclosure enclosing the tube and fins to define at least a part of a flow path for the second fluid in a region of the tube and fins from a second fluid inlet to a second fluid outlet, a wall interior of the enclosure to define a first section of the flow path for the second fluid in the enclosure which first section leads from the second fluid inlet and extends in a first direction substantially perpendicular to a length of the elongated segments of the tube, the wall further defining a second section of the flow path for the second fluid in the enclosure which second section extends in an opposite direction from the first section substantially perpendicular to the length of the elongated segments of the tube and leads to the second fluid outlet, the interior wall being shaped and arranged in the enclosure such that a cross sectional area of the flow path for the second fluid in the enclosure changes along its length from the second fluid inlet to the second fluid outlet.

12. The heat transfer device according to claim 11, wherein an interior of the enclosure is substantially rectangular with a generally constant cross-sectional area along its height and long its length.

13. The heat transfer device according to claim 11, wherein the wall is substantially planar and is arranged at an angle to the length of the elongated segments of the tube.

14. The heat transfer device according to claim 11, wherein the wall has a zig-zag shape with an alternating series of sections parallel and perpendicular to the length of the straight segments of the tube.

15. The heat transfer device according to claim 11, wherein the heat transfer device forms a portion of at least one of an evaporator and a condenser in a refrigeration appliance.

16. The heat transfer device according to claim 11, wherein the first section of the flow path for the second fluid has a downstream end at one end of the wall with a cross sectional area substantially identical to a cross sectional area of the second section of the flow path for the second fluid at an upstream end at the same end of the wall.

17. The heat transfer device according to claim 11, wherein the cross sectional area of the flow path for the second fluid in the enclosure decreases along its length from the second fluid inlet to the second fluid outlet.

18. The heat transfer device according to claim 11, wherein the first section of the flow path for the second fluid extends across at least a portion of the length of substantially all of the elongated segments of the tube and the second section of the flow path for the second fluid extends across at least a portion of the length of substantially all of the elongated segments of the tube.

19. A refrigeration appliance having a refrigeration circuit with a compressor, a condenser and an evaporator, wherein at least one of the condenser and evaporator includes a heat transfer device comprising:

a tube having a first fluid inlet and a first fluid outlet, the tube arranged to form a plurality of generally parallel elongated segments of the tube, an enclosure enclosing the tube to define at least a part of a flow path for a second fluid over an exterior surface of the tube from a second fluid inlet to a second fluid outlet, a wall interior of the enclosure to define a first section of the flow path for the second fluid in the enclosure which first section leads from the second fluid inlet and extends across at least a first portion of a length of substantially all of the elongated segments of the tube, the wall further defining a second section of the flow path for the second fluid in the enclosure which second section extends across at least a second portion of the length of substantially all of the elongated segments of the tube and leads to the second fluid outlet, the interior wall being shaped and arranged in the enclosure such that a cross sectional area of the flow path for the second fluid in the enclosure changes along its length from the second fluid inlet to the second fluid outlet.

* * * * *